US005278371A

United States Patent [19]

Watanabe et al.

[11] Patent Number: 5,278,371

[45] Date of Patent: Jan. 11, 1994

[54] KEYSWITCH ASSEMBLY WITH SUPPORT MECHANISM COUPLED TO SUPPORT PLATE BENEATH PRINTED CIRCUIT BOARD

[75] Inventors: Makoto Watanabe, Nagoya; Isao Mochizuki, Kaizu, both of Japan

[73] Assignee: Brother Kogyo Kabushiki Kaisha, Nagoya, Japan

[21] Appl. No.: 967,070

[22] Filed: Oct. 28, 1992

[30] Foreign Application Priority Data

Feb. 14, 1992 [JP] Japan ..... 4-061395

[51] Int. Cl.[5] ..... H01H 3/12

[52] U.S. Cl. ..... 200/344

[58] Field of Search ..... 200/344, 517

[56] References Cited

U.S. PATENT DOCUMENTS 3,174,685 3/1965 Swanson .
3,857,007 12/1974 Leuenberger .
4,433,225 2/1984 Cowles .
4,492,829 1/1985 Rodrique ..... 200/513 X

FOREIGN PATENT DOCUMENTS 0134509 3/1985 European Pat. Off. .
0142593 5/1985 European Pat. Off. .
0295437 12/1988 European Pat. Off. .
2175105 10/1973 France .
2-5236 1/1990 Japan .
4-76224 7/1992 Japan .

*Primary Examiner*—Renee S. Luebke
*Attorney, Agent, or Firm*—Oliff & Berridge

[57] ABSTRACT

A keyswitch assembly for a keyboard for a word processor or a computer comprises a key, a key support mechanism supporting the key formed by pivotally joining two support levers in a scissors-like form, a rubber spring disposed under the key support mechanism, and a support plate supporting the key support mechanism, the rubber spring and a printed wiring board on its surface. The key support mechanism is connected to the key and the support plate by slidably fitting pivots formed on the upper ends of the support levers in the slots of guiding parts formed on the lower surface of the key and slidably fitting pivots formed on the lower ends of the support levers in slots formed by raising portions of the support plate. The omission of a base plate, which is an essential component of a prior art keyswitch assembly, reduces the number of parts and the manufacturing cost and simplifies the construction of the keyswitch assembly.

37 Claims, 4 Drawing Sheets

KEYSWITCH ASSEMBLY WITH SUPPORT MECHANISM COUPLED TO SUPPORT PLATE BENEATH PRINTED CIRCUIT BOARD

BACKGROUND OF THE INVENTION

1. Field of the Invention

The present invention relates to a keyswitch assembly and, more particularly, to a keyswitch assembly consisting of a relatively small number of parts, having a simple construction, capable of being manufactured at a relatively low manufacturing cost and suitable for use on a thin keyboard for a portable word processor, a portable personal computer or the like.

2. Description of Related Art

A known keyswitch assembly for use on such a keyboard has a key provided with a stem, a base plate provided with a key support having a hole receiving the stem of the key to guide the key for vertical movement, and a switching member, such as a membrane switch, disposed under the stem. When the key is depressed, the lower end of the stem of the key presses the switching member for switching action.

A keyswitch assembly provided with a large key, such as a space key and a return key, is provided with a mechanism for maintaining the key supported on a base plate in a level position when the key is depressed. Such keyswitch assemblies are disclosed in U.S. Pat. Nos. 4,580,022, 4,902,862 and 4,433,225.

In a keyswitch assembly disclosed in the '022 patent, a key member is supported on support levers connected with pins in a scissors-like form, and switching members are disposed apart from the central portion of the key member. Pins attached to the opposite ends of the support levers slide horizontally along the inner surface of the key member and the upper surface of a base plate when the key member is depressed. Stems formed in the key member and guided by a guide member slide vertically to compress the switching members when the key member is depressed.

A keyswitch assembly disclosed in the '862 patent is the same in basic construction as the keyswitch assembly disclosed in the '022 patent and is characterized in that the key member can be easily connected to and removed from the support levers which are coupled to a base plate.

In the '225 patent, a keyswitch assembly including an L-shaped keytop is disclosed. The keyswitch assembly comprises a pair of lever arms joined at intermediate portions thereof by a pivot to form a scissors-like linkage having first, second, third, and fourth ends. The first and second ends of the scissors-like linkage are pivotally slidable within the cantilevered portion of the keytop. However, a keyswitch portion is separately disposed from the scissors-like linkage. So, there is a problem that the keyswitch is not perfectly operated. Furthermore, a plunger and base plate are needed, so the assembly requires many parts, and the structure is complex.

Recent progressive reduction in size and thickness of word processors and personal computers requires reduction in size and thickness of keyboards to be incorporated into word processors and personal computers. On the other hand, the keys of keyboards must be adequately supported to facilitate keystroke operation and to secure a reliable keystroke. The prior art keyswitch assemblies, therefore, utilize base plates to secure the key support member thereto.

The keyswitch assemblies disclosed in the foregoing references are not intended to enable the reduction of the thickness of the keyboard. Since all of the above references require a base plate, none of these references are able to reduce the thickness and weight of the keyboard satisfactorily.

Further, the manufacturing cost of a base plate is relatively high and adds to the total cost of the keyboard.

SUMMARY OF THE INVENTION

It is an object or the present invention to provide a keyswitch assembly which does not require a base plate, consists of a relatively small number of parts, has a simple construction, is capable of being manufactured at a relatively low manufacturing cost and ensures satisfactory key operation.

In one aspect of the present invention, a keyswitch assembly comprises: a key provided with two first guiding parts projecting from the lower surface thereof; a key support mechanism disposed under the key and formed by pivotally joining two support levers each having opposite ends provided with pivots in a scissors-like form by a pivotal joint; a printed wiring board; a switching member mounted on the printed wiring board; and a support plate provided with second guiding parts respectively corresponding to the first guiding parts. The pivots formed on the upper ends of the support levers are connected to the first guiding parts, and the pivots formed on the lower ends of the support levers are connected to the second guiding parts.

When the key is depressed, the support levers turn relative to each other on the pivotal joint, and the pivots of the support levers slide horizontally in the first guiding parts of the key and the second guiding parts of the support plate, respectively.

As the key is depressed further, the switching member is compressed for switching action by the pivotal joint. When the key is released, the key and the support levers are returned to their original positions by the resilience of the switching member.

Thus, the present invention provides a keyswitch assembly not needing any base plate, consisting of a relatively small number of parts, having a simple construction, capable of being manufactured at a relatively low manufacturing cost and capable of ensuring satisfactory key operation.

BRIEF DESCRIPTION OF THE DRAWINGS

A preferred embodiment of the present invention will be described in detail with reference to the accompanying drawings, in which.

DETAILED DESCRIPTION OF THE PREFERRED EMBODIMENTS

Figure 1:
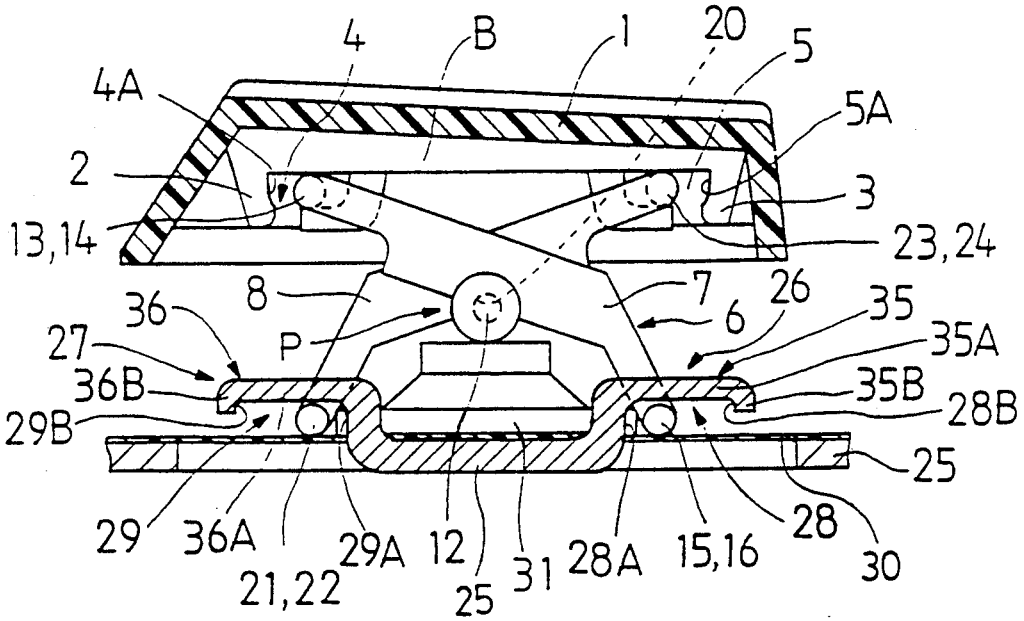
FIG. 1 is a sectional side view of a keyswitch assembly in a preferred embodiment according to the present invention in a state where a key is depressed slightly.

A keyswitch assembly in a preferred embodiment according to the present invention will be described hereinafter with reference to FIGS. 1 and 2. FIG. 1 is a sectional side view of the keyswitch assembly in a state where a key is depressed slightly, and FIG. 2 is an exploded view of the keyswitch assembly.

Figure 2:
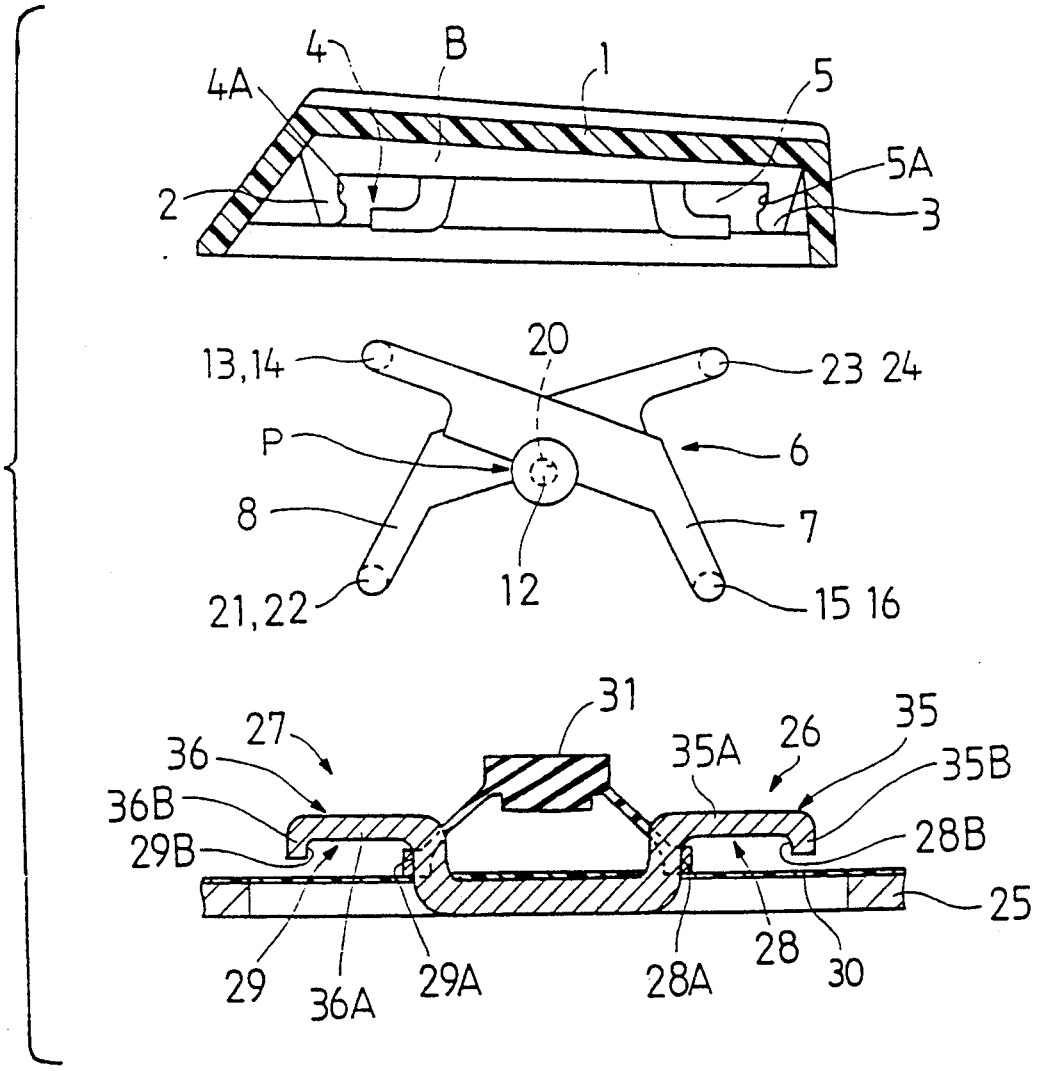
FIG. 2 is an exploded sectional view of the keyswitch assembly of FIG. 1.

Referring to FIGS. 1 and 2, a key 1 is preferably formed of a synthetic resin, such as ABS resin, by molding. A character such as an alphabetic character is formed by printing or the like on the upper surface of the key 1. A pair of connecting members B, preferably formed integral with the underside of the key 1, are each provided with first guiding parts 2 and 3 projecting downward from the lower surface of the key 1. Each connecting member is disposed on a longitudinal side of the key.

A key support mechanism 6 in the form of a scissors-type linkage consisting of the first support lever 7 and the second support lever 8 pivotally connected to each other is disposed under the key 1 to support the key 1 for vertical movement.

The pair of guiding parts 2 are provided with slots 4 for horizontally slidably receiving pivots 13 and 14 formed on the upper end of the first support lever 7. The outward movement of the pivots 13 and 14 in the slots 4 is limited by end walls 4A. The pair of guiding parts 3 are provided with slots 5 for horizontally slidably receiving pivots 23 and 24 formed on the upper end of the second support lever 8. The outward movement of the pivots 23 and 24 in the slots 5 is limited by end walls 5A which define stops to limit the vertical movement of the key.

Figure 3:
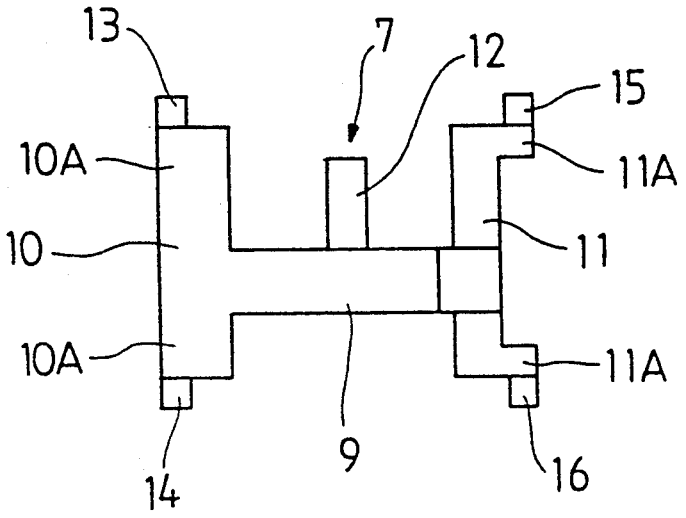
FIG. 3 is a plan view of a first support lever.

As shown in FIG. 3, the first support lever 7 has, preferably in an integral piece, a body 9, two arms 10 and 11 formed respectively at the opposite ends of the body 9, and a shaft 12 laterally projecting from the central portion of one side of the body 9.

The pivots 13 and 14 project from the opposite ends 10A of the arm 10. The pivots 13 and 14 are received slidably in the slots 4 formed in the guiding parts 2 of the key 2 and act as sliding formations. The arm 11 has a shape resembling the letter U in plan view. The pivots 15 and 16 project from the opposite ends 11A of the arm 11. The pivots 15 and 16 are connected to guiding parts 26 formed in a support plate 25 and act as sliding formations.

Figure 4:
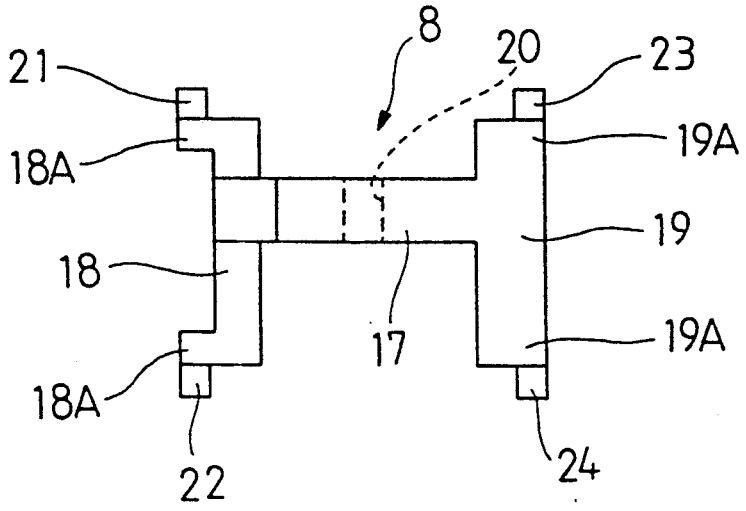
FIG. 4 is a plan view of a second support lever.

As shown in FIG. 4, the second support lever 8 has, preferably in an integral piece, a body 17 and two arms 18 and 19 formed respectively at the opposite ends of the body 17. The hole 20 is formed in the central portion of the body 17 to receive the shaft 12 formed on the body 9 of the first support lever 7 therein. The arm 18 has a shape resembling the letter U in plan view, and the pivots 21 and 22 project respectively from the opposite ends 18A of the arm 18. The pivots 21 and 22 are connected to guiding parts 27 formed in the support plate 25 and act as sliding formations. The pivots 23 and 24 project respectively from the opposite ends 19A of the arm 19. The pivots 23 and 24 are received slidably in the slots 5 formed in the guiding parts 3 of the key 1 and act as sliding formations.

The pair of pivots 13 and 14 of the first support lever 7 are formed at the ends of arm 10 and diametrically opposite to the pair of pivots 15 and 16 of the same formed on the ends of arm 11 with respect to the axis of the shaft 12. The axes of the pivots are each spaced the same distance from the axis of the shaft 12. The pair of pivots 21 and 22 of the second support lever 8 are formed at the ends of arm 18 and are diametrically opposite to the pair of pivots 23 and 24 formed at the ends of arm 19 with respect to the center axis of the hole 20. The axes of the pivots are each spaced the same distance from the axis of the center hole 20.

The key support mechanism 6 is formed by pivotally fitting the shaft 12 formed on the body 9 of the first support lever 7 in the hole 20 formed in the body 17 of the second support lever 8 so that the support levers 7 and 8 are able to turn relative to each other along a pivot axis on the pivotal joint P consisting of the shaft 12 and the hole 20. The pivotal joint P is located opposite to the substantially central portion of the upper wall of a rubber spring 31.

The lower portions of the support levers 7 and 8 provided with the arms 11 and 18 are bent down so that the support levers 7 and 8 have an upward convex shape when joined together thus forming a relatively large downwardly concave space under a pivotal joint P as shown in FIG. 1. Accordingly, the rubber spring 31 having the shape of a truncated hollow cone can be easily accommodated in the space under the pivotal joint P.

When the support levers 7 and 8 are connected to the key 1, the pair of pivots 13 and 14 and the pair of pivots 23 and 24 are pressed against the end walls 4A and 5A, respectively, to restrain the key 1 from free movement relative to the support levers 7 and 8 in directions perpendicular to the paper.

A generally planar support plate 25 formed of a thin metal sheet, such as a steel sheet, is disposed under the key support mechanism 6. The support plate 25 is provided with guiding parts 26 and 27 for guiding the pivots 15 and 16 formed on the arm 11 of the first support lever 7 and the pivots 21 and 22 formed on the arm 18 of the second support lever 8, respectively.

Figure 5:
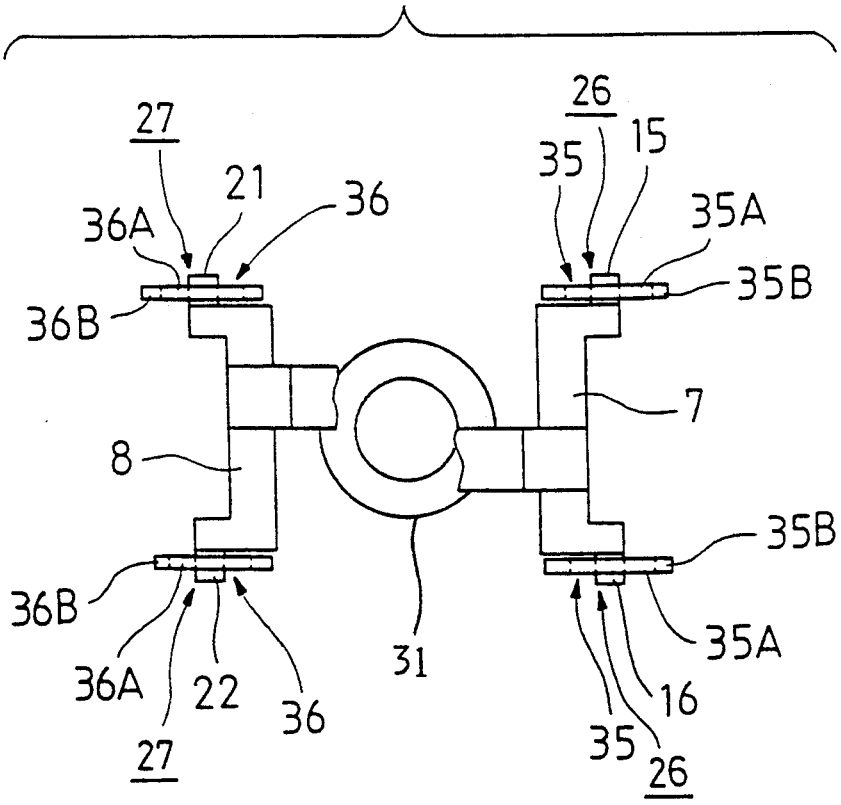
FIG. 5 is a partial plan view of guiding parts formed on a support plate.

As shown in FIG. 5, the guiding parts 26 have guiding lugs 35 of a predetermined rectangular shape (FIGS. 1 and 2) formed by raising portions of the support plate 25 in the opposite corners of one end of an area allocated to the keyswitch assembly by pressing.

Each of the guiding lugs 35 has a horizontal portion 35A generally parallel to the upper surface of the support plate for guiding the pivot 15 (16) for horizontal sliding and a vertical portion 35B projecting downward from the outer end of the horizontal portion 35A. The horizontal portion 35A and the vertical portion 35B define an elongate slot 28. The pivot 15 (16) of the first support lever 7 is fitted slidably in the slot 28. The slot 28 has a first end 28A, i.e., the left-hand end in FIG. 1, and a second end 28B, i.e., the right-hand end in FIG. 1. The pivot 15 (16) of the support lever 7 is pressed against the first end 28A when the key 1 is not depressed. The second end 28B limits the sliding movement of the pivot 15 (16) when the key 1 is depressed.

As shown in FIG. 5, guiding parts 27, similarly to the guiding parts 26, have guiding lugs 36 of a predetermined rectangular shape (FIGS. 1 and 2) formed by raising portions of the support plate 25 in the opposite corners of the other end of the area allocated to the keyswitch assembly by pressing.

Similar to guiding lugs 35, each of the guiding lugs 36 has a horizontal portion 36A for guiding the pivot 21 (22) for horizontal sliding and a vertical portion 36B projecting downward from the outer end of the horizontal portion 36A. The horizontal portion 36A and the vertical portion 36B define an elongate slot 29. The pivot 21 (16) of the second support lever 8 is fitted slidably in the slot 29.

The slot 29, similarly to the slot 28, has a first end 29A, i.e., the right-hand end in FIG. 1, and a second end 29B, i.e., the left-hand end in FIG. 1. The pivot 21 (22) is pressed against the first end 29A when the key 1 is not depressed. The second end 29B limits the horizontal sliding movement to the left of the pivot 21 (22) of the second support lever 8.

While the key 1 is not depressed, the pivots 15 and 16 of the first support lever 7 are pressed against the first ends 28A of the slots 28, and the pivots 21 and 22 of the second support lever 8 are pressed against the first ends 29A of the slots 29 by the resilient force of the rubber spring 31 biasing the pivotal joint P upward to keep the key 1 at its original position.

When the key 1 is depressed, the rubber spring 31 is compressed to complete a switching action before the rightward sliding movement, as viewed in FIG. 5, of the pivots 15 and 16 of the first support lever 7 and the leftward sliding movement, as viewed in FIG. 5, of the pivots 21 and 22 of the second support lever 8 are limited by the second ends 28B of the slots 28 and the second ends 29B of the slots 29, respectively.

The guiding lugs 35 and 36 restrain the support levers 7 and 8 from free movement and prevent the shaft 12 from coming out of the hole 20.

A flexible printed wiring or circuit board 30 provided with printed circuits including switching electrodes, not shown, is attached to the upper surface of the support plate 25. The rubber spring 31 having the shape of an inverted cup and internally provided with a known movable electrode is placed on the flexible printed wiring board 30 at a position corresponding to the switching electrodes, directly beneath the pivotal joint P pivotally joining the support levers 7 and 8. The upper wall of the rubber spring 31 is formed in a thickness such that the upper wall will not be deformed when pressed by the pivotal joint P.

The flexible printed wiring board 30 is provided with openings, not shown, through which the raised guiding lugs 35 and 36 protrude above the flexible printed wiring board 30 as shown in FIGS. 1 and 2.

When the pivotal joint P moves downward, the pivots 13 and 14 slide along the slots 4 and the pivots 23 and 24 slide along the slots 5 in parallel to the surface of the flexible printed wiring board 30, so that the pivotal joint P comes into contact with and compresses the rubber spring 31 at the substantially central portion of the upper wall of the rubber spring 31 to compress the rubber spring 31. When compressed beyond a limit, the rubber spring 31 buckles to connect the switching electrodes electrically by the movable electrode of the rubber spring 31.

The operation of the keyswitch assembly thus constructed will be described hereinafter. While the key 1 is not depressed, the pivots 15 and 16 of the first support lever 7 are held in contact with the first ends 28A of the slots 28 and the pivots 21 and 22 of the second support lever 8 are held in contact with the first ends 29*a* of the slots 29 by the resilience of the rubber spring 31, so that the key 1 is maintained at its original position and is horizontally immovable.

When the key is depressed, the pivots 13 and 14 of the first support lever 7 slide horizontally to the left, as viewed in FIG. 1, along the slots 4 of the guiding parts 2, and the pivots 23 and 24 of the second support lever 8 slide horizontally to the right, as viewed in FIG. 1, along the slots 5 of the guiding parts 3. At the same time, the pivots 15 and 16 of the first support lever 7 slide horizontally to the right, as viewed in FIG. 1, along the slots 28 of the guiding parts 26 of the support plate 25, and the pivots 21 and 22 of the second support lever 8 slide horizontally to the left, as viewed in FIG. 1, along the slots 29 of the guiding parts 27 of the support plate 25.

Consequently, the pivotal joint P pivotally joining the support levers 7 and 8 compresses the rubber spring 31 gradually and, when the compression of the rubber spring 31 exceeds a limit, the rubber spring 31 buckles. Then, the movable electrode of the rubber spring 31 connects the switching electrodes of the flexible printed wiring board 30 electrically for switching action.

Although the key 1 is depressed further after the switching action has been completed, the leftward sliding movement of the pivots 13 and 14 of the first support lever 7 along the slots 4 is limited by the end walls 4A, and the rightward sliding movement of the pivots 23 and 24 of the second support lever 8 along the slots 5 is limited by the end walls 5A. At the same time, the rightward sliding movement of the pivots 15 and 16 of the first support lever 7 along the slots 28 is limited by the second ends 28B of the slots 28, and the leftward sliding movement of the pivots 21 and 22 of the second support lever 8 along the slots 29 is limited by the second ends 29B of the slots 29.

After the pivotal joint P has thus compressed the rubber spring 31 when the key 1 is depressed to bring the movable electrode of the rubber spring 31 into contact with the switching electrodes of the flexible wiring board 30 for switching action, the sliding movement of the pivots 13 and 14, the pivots 23 and 24, the pivots 15 and 16, and the pivots 21 and 22 is limited by the end walls 4A, the end walls 5A, the second ends 28B and the second ends 29B, respectively, to limit the further downward movement of the key 1, so that the key 1 is restrained from free horizontal and vertical movement.

When the key 1 is released, the resilience of the rubber spring 31 pushes up the pivotal joint P pivotally joining the support levers 7 and 8, causing the pivots 13, 14, 15, 16, 21 and 22 to move in the reverse directions, whereby the key 1 is returned to its original position.

As is apparent from the foregoing description, the keyswitch assembly in accordance with the present invention has the support plate 25 provided with the guiding lugs 35 and 36 forming the guiding parts 26 and 27 having the slots 28 and 29, respectively. The pivots 13 and 14, the pivots 15 and 16, the pivots 23 and 24, and the pivots 21 and 22 are guided for horizontal sliding movement by the slots 4 of the guiding parts 2 of the key 1, the slots 28 of the guiding parts 26 of the support plate 25, the slots 5 of the guiding parts 3 of the key i, and the slots 29 of the guiding parts 27 of the support plate 25, respectively. Accordingly, the keyswitch assembly of the present invention need not be provided with any base plate, which is an essential component of the prior art keyswitch assembly.

Since the pivots 15 and 16 of the first support lever 7 are held in contact with the first end 28A of the slots 28 and the pivots 21 and 22 of the second support lever 8 are held in contact with the first ends 29A of the slots 29 by the resilience of the rubber spring 31 when the key i is not depressed, the key 1 is restrained from horizontal movement and kept in place.

Since the pivots 13 and 14 of the first support plate 7 and the pivots 23 and 24 of the second support lever 8 are brought into contact with the end walls 4A of the slots 4 and the end walls 5A of the slots 5, respectively, and the pivots 15 and 16 of the first support lever 7 and the pivots 21 and 22 of the second support lever 8 are brought into contact with the second ends 28B of the slots 28 and the second ends 29B of the slots 29, respectively, when the key is depressed, the key 1 is restrained from free horizontal movement after the movable electrode of the rubber spring 31 has been brought into contact with the switching electrodes of the flexible printed wiring board 30 for switching action.

Thus, the key 1 of the keyswitch assembly is restrained from free horizontal movement in both a state where the key 1 is not depressed and a state where the key 1 is depressed, which ensures satisfactory key operation and reliable switching action.

Thus, the keyswitch assembly of the present invention can be constructed by a relatively small number of parts at a relatively low manufacturing cost and ensures satisfactory key operation.

If the frictional resistance of the flexible printed wiring board 30 against the sliding movement of the pivots 15, 16, 21 and 22 is higher than that of the support plate 25, openings may be formed in the flexible printed wiring board 30 to make the pivots 15, 16, 21 and 22 slide along the surface of the support plate 25.

The present invention is not limited to the foregoing embodiment in its practical application, and many variations and modifications are possible therein without departing from the scope of the present invention. For example, the key supporting mechanism formed by pivotally joining the support levers 7 and 8 in a scissors-like form may be substituted for the same effects by a key support mechanism of a pantograph type.

What is claimed is:

1. A keyswitch assembly comprising:

a key having a lower surface integrally provided with connecting means having at least two first guiding parts projecting from the lower surface;

a support supporting the key for vertical movement with respect to the lower surface of the key and coupled to the at least two first guiding parts;

a switching member disposed under the support so as to be compressed for switching action by the support when the key is depressed;

a printed circuit board disposed under the switching member; and a support plate having an upper surface, disposed under the printed circuit board, supporting the printed circuit board on the upper surface and provided with at least two second guiding parts positioned to correspond to the at least two first guiding parts, respectively, wherein the support is coupled to the at least two second guiding parts, the printed circuit board being disposed between the support plate and the support.

2. The keyswitch assembly according to claim 1, wherein the support comprises two support levers joined in a scissors-type linkage at a pivot axis, each lever having an opposite upper end and a lower end slidably coupled to the first and second guiding parts respectively.

3. The keyswitch assembly according to claim 2, wherein each lever has a body, an upper arm and a lower arm, the upper arm and the lower arm each extending generally perpendicular to said body and having sliding formations thereon.

4. The keyswitch assembly according to claim 3, wherein the sliding formations are a pair of outwardly extending pivot members.

5. The keyswitch assembly according to claim 3, wherein one support lever has a shaft extending laterally from the body and the other lever has a hole extending laterally through the body, the shaft rotatably secured in the hole.

6. The keyswitch assembly according to claim 3, wherein the lower ends and bodies of the levers define an downwardly concave space and the switching member is positioned within the downwardly concave space.

7. The keyswitch assembly according to claim 1, wherein the first guiding parts are elongated slots.

8. The keyswitch assembly according to claim 1, wherein the upper surface of the support plate is generally planar and the second guiding parts extend integrally upwardly from the upper surface.

9. The keyswitch assembly according to claim 1, wherein the second guiding parts are elongated slots.

10. The keyswitch assembly according to claim 1, wherein the second guiding parts have first and second longitudinally aligned ends which define stops which limit vertical movement of the key.

11. The keyswitch assembly according to claim 1, wherein the second guiding parts are lugs pressed from the support plate and extend generally parallel to the upper surface of the support plate.

12. The keyswitch assembly according to claim 1, wherein the second guiding parts are lugs which extend upwardly through the printed circuit board.

13. A keyswitch assembly comprising:

a key having a lower surface provided integrally with first guiding parts;

a support plate having an upper surface disposed below the key and provided with second guiding parts positioned to correspond to the first guiding parts, wherein said second guiding parts are lugs pressed from the support plate;

a key support coupled to the first guiding parts and the second guiding parts for supporting the key for vertical movement with respect to the support plate;

a printed circuit board disposed on the upper surface of the support plate and below the key support; and a switching member disposed between the key and the printed circuit board so as to be operated for switching action when the key is depressed.

14. The keyswitch assembly according to claim 13, wherein the key support comprises a first support lever and a second support lever connected in a scissors-type linkage and having a pivot axis, wherein sliding formations are formed on each end of the first support lever and the second support lever which slidingly engage the first guiding parts of the key and the second guiding parts of the base plate, respectively, for horizontal sliding with respect to the lower surface of the key.

15. The keyswitch assembly according to claim 14, wherein at least one of the first and second guiding parts are elongated slots with first and second stops for limiting the sliding movement of the levers.

16. The keyswitch assembly according to claim 14, wherein each lever has a body, an upper arm and a lower arm, the upper arm and the lower arm extending generally perpendicular to said body and comprising the sliding formations.

17. The keyswitch assembly according to claim 14, wherein the lower ends and bodies of the levers define a downwardly concave space and the switching member is positioned within the downwardly concave space.

18. The keyswitch assembly according to claim 13, wherein the first guiding parts are elongated slots.

19. The keyswitch assembly according to claim 13, wherein the second guiding parts are elongated slots.

20. The keyswitch assembly according to claim 13, wherein the upper surface of the support plate is generally planar and the second guiding parts extend integrally upwardly from the upper surface.

21. The keyswitch assembly according to claim 13, wherein the second guiding parts have first and second longitudinally aligned ends which define stops which limit vertical movement of the key.

22. The keyswitch assembly according to claim 13, wherein the lugs extend generally parallel to the upper surface of the support plate.

23. The keyswitch assembly according to claim 13, wherein the second guiding parts are lugs which extend upwardly through the printed circuit board.

24. A keyswitch assembly comprising:

a key having a lower surface provided with first guiding parts;

a support plate having an upper surface disposed below the key and provided with second guiding parts positioned to correspond to the first guiding parts;

a key support having an upper end slidingly coupled to the first guiding parts and a lower end slidingly coupled to the second guiding parts for supporting the key for vertical movement with respect to the support plate, the key support delimiting a downwardly concave space located beneath the lower surface of the key; and a switching member disposed between the key and the support plate within the downwardly concave space of the key support, wherein the key support bears on and actuates the switching member upon depression of the key.

25. The keyswitch assembly according to claim 24, further comprising a printed circuit board disposed on the upper surface of the support plate and below the key support.

26. The keyswitch assembly according to claim 25, wherein the second guiding parts are lugs which extend upwardly through the printed circuit board.

27. The keyswitch assembly according to claim 24, wherein the key support comprises a scissors-type linkage with a pivot axis, the switching member being disposed directly below the pivot axis so as to be operated for switching action when the key is depressed.

28. The keyswitch assembly according to claim 24, wherein the first guiding parts are elongated slots.

29. The keyswitch assembly according to claim 24, wherein the upper surface of the support plate is generally planar and the second guiding parts extend integrally upwardly from the upper surface.

30. The keyswitch assembly according to claim 24, wherein the second guiding parts are elongated slots.

31. The keyswitch assembly according to claim 24, wherein the second guiding parts have first and second longitudinally aligned ends which define stops which limit vertical movement of the key.

32. The keyswitch assembly according to claim 24, wherein the second guiding parts are lugs pressed from the support plate and extend generally parallel to the upper surface of the support plate.

33. A keyswitch assembly comprising:

a key having a lower surface provided with first guiding parts;

a support plate having an upper surface disposed below the key and provided with second guiding parts positioned to correspond to the first guiding parts, wherein said second guiding parts are lugs pressed from the support plate;

a key support supporting the key for vertical movement with respect to the support plate, the key support comprising a first pair of pivotally connected levers and a second pair of pivotally connected levers, the first pair of levers and the second pair of levers arranged in parallel, each lever having an upper end slidingly coupled to the first guiding parts and a lower end slidingly coupled to the second guiding parts, the key support delimiting a downwardly concave space located beneath the lower surface of the key; and a switching member disposed beneath the key support within the downwardly concave space of the key support, wherein the lower ends of the levers define an area which circumscribes the switching member.

34. The keyswitch assembly according to claim 33, further comprising a printed circuit board disposed on the upper surface of the support plate and below the key support.

35. The keyswitch assembly according to claim 33, wherein the first pair of levers and the second pair of levers are connected.

36. The keyswitch assembly according to claim 33, wherein the switching member is compressed and switching is actuated by the key support when the key is depressed.

37. The keyswitch assembly according to claim 33, wherein the second guiding parts are integral lugs extending generally parallel to the upper surface of the support plate defining elongated slots with an open end for receiving the lower ends of the levers.

* * * * *